US008371726B2

(12) United States Patent
Collins et al.

(10) Patent No.: US 8,371,726 B2
(45) Date of Patent: Feb. 12, 2013

(54) RECESSED LUMINAIRE WITH A REFLECTOR

(75) Inventors: Scotty Collins, Tupelo, MS (US); Scott Livingston, Louisville, MS (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 443 days.

(21) Appl. No.: 12/787,835

(22) Filed: May 26, 2010

(65) Prior Publication Data

US 2010/0302768 A1 Dec. 2, 2010

Related U.S. Application Data

(60) Provisional application No. 61/181,629, filed on May 27, 2009.

(51) Int. Cl.
*F21V 15/00* (2006.01)

(52) U.S. Cl. ..... 362/364; 362/296.01; 362/297; 362/310

(58) Field of Classification Search ..... 362/364, 362/296.01, 297, 310
See application file for complete search history.

(56) References Cited

U.S. PATENT DOCUMENTS

| | | | | |
|---|---|---|---|---|
| 3,433,941 | A * | 3/1969 | Hall | 362/297 |
| 4,002,894 | A * | 1/1977 | Kintz | 362/261 |
| 4,066,887 | A | 1/1978 | Levis | |
| 5,416,683 | A | 5/1995 | McCarthy | |
| 5,426,575 | A | 6/1995 | Richards | |
| 5,816,694 | A | 10/1998 | Ideker | |
| 5,964,523 | A | 10/1999 | Eversberg | |
| RE36,908 | E | 10/2000 | Ling | |
| 6,350,047 | B1 | 2/2002 | Ng et al. | |
| 6,371,630 | B1 | 4/2002 | Unger | |
| 6,478,454 | B1 | 11/2002 | Jaffari et al. | |
| 7,784,976 | B2 * | 8/2010 | Chon | 362/297 |
| 2003/0002279 | A1 | 1/2003 | Fiene | |
| 2008/0212326 | A1 * | 9/2008 | Chon | 362/296 |
| 2009/0231840 | A1 | 9/2009 | Boehme et al. | |

OTHER PUBLICATIONS

Day Brite Lighting Data sheet Recessed 2×2 Static Lensed Lamp, Sep. 2001.

Product specification sheet for Day-Brite Lighting's recessed 2×2/ static lensed luminaire, product No. CI-14020 (Sep. 2001).

* cited by examiner

*Primary Examiner* — Diane Lee
*Assistant Examiner* — Sean Gramling

(57) ABSTRACT

A HID recessed luminaire is disclosed and described. The HID recessed luminaire includes a reflector that has a primary reflector portion and a secondary reflector portion. The primary reflector portion defines a first frustum of a pyramid and the secondary reflector portion defines a second frustum of a pyramid. Optionally, a portion of the primary reflector and a portion of the secondary reflector are integrally connected to one another.

15 Claims, 6 Drawing Sheets

RECESSED LUMINAIRE WITH A REFLECTOR

CROSS-REFERENCE TO RELATED DOCUMENTS

This patent application claims priority to U.S. provisional patent application No. 61/181,629, filed on May 27, 2009.

BACKGROUND

1. Field of the Invention

This invention pertains generally to a recessed luminaire, and more particularly to a recessed luminaire with a reflector.

2. Description of the Related Art

Recessed luminaires typically include structure for installing the recessed luminaire, a socket, a lamp, and at least one reflector. The reflector may be designed to provide desired light distribution characteristics when a light source is in use in the recessed luminaire. For example, a HID recessed 2×2 recessed luminaire may be adapted for installation in a two foot by two foot ceiling grid and have a reflector measuring approximately two foot by two foot. The reflector may provide a desired light distribution when a HID light source such as a Metal Halide (MH) Lamp, High Pressure Sodium (HPS) Lamp, or Pulse Start Metal Halide (PSMH) Lamp is installed in the light fixture.

BRIEF DESCRIPTION OF THE ILLUSTRATIONS

DETAILED DESCRIPTION

Figure 1:
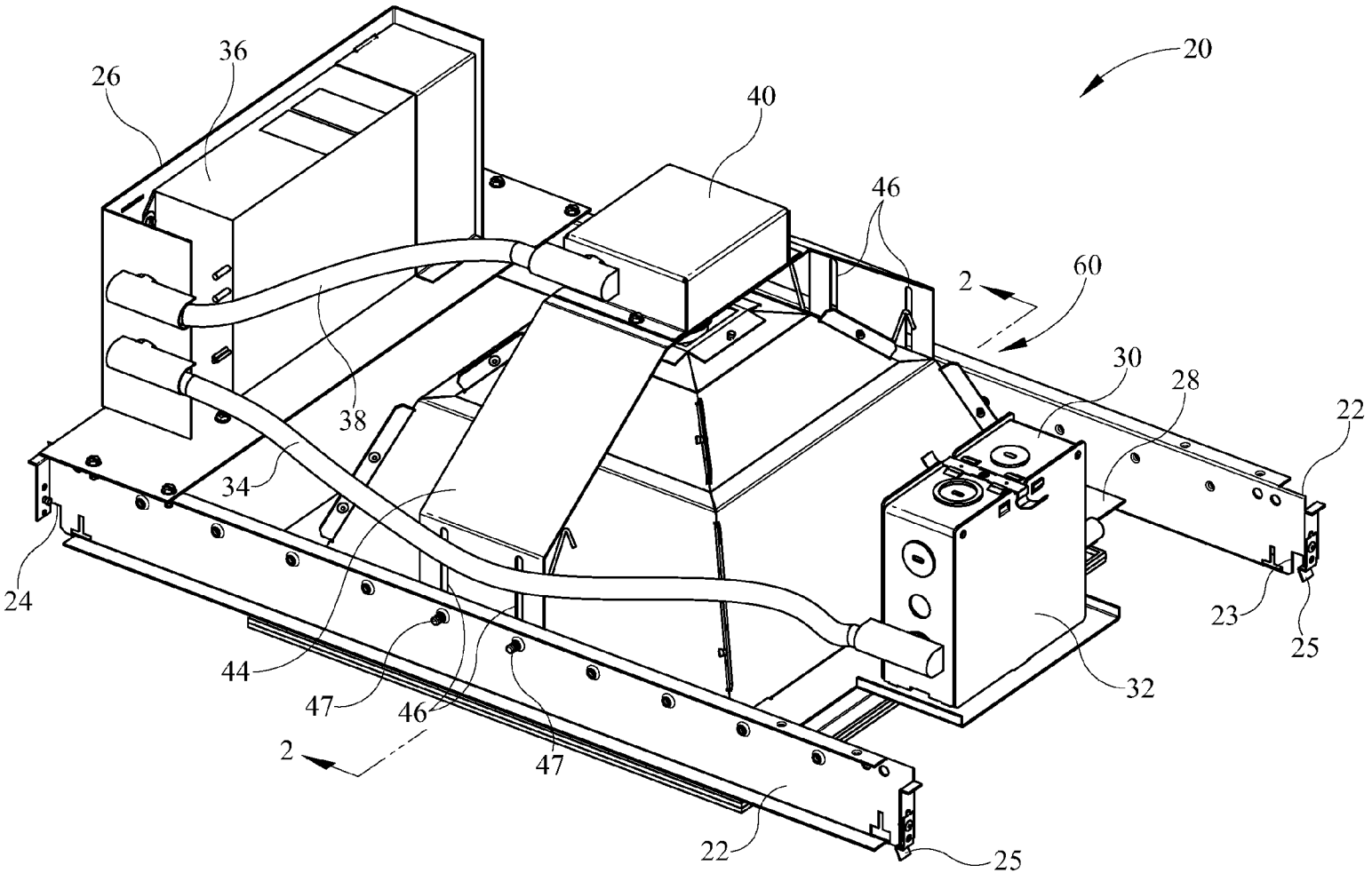
FIG. 1 is a top perspective view of an embodiment of a HID recessed luminaire with a reflector.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," "in communication with" and "mounted," and variations thereof herein are used broadly and encompass direct and indirect connections, couplings, and mountings. In addition, the terms "connected" and "coupled" and variations thereof are not restricted to physical or mechanical connections or couplings.

Furthermore, and as described in subsequent paragraphs, the specific mechanical configurations illustrated in the drawings are intended to exemplify embodiments of the invention and that other alternative mechanical configurations are possible.

Figure 2:
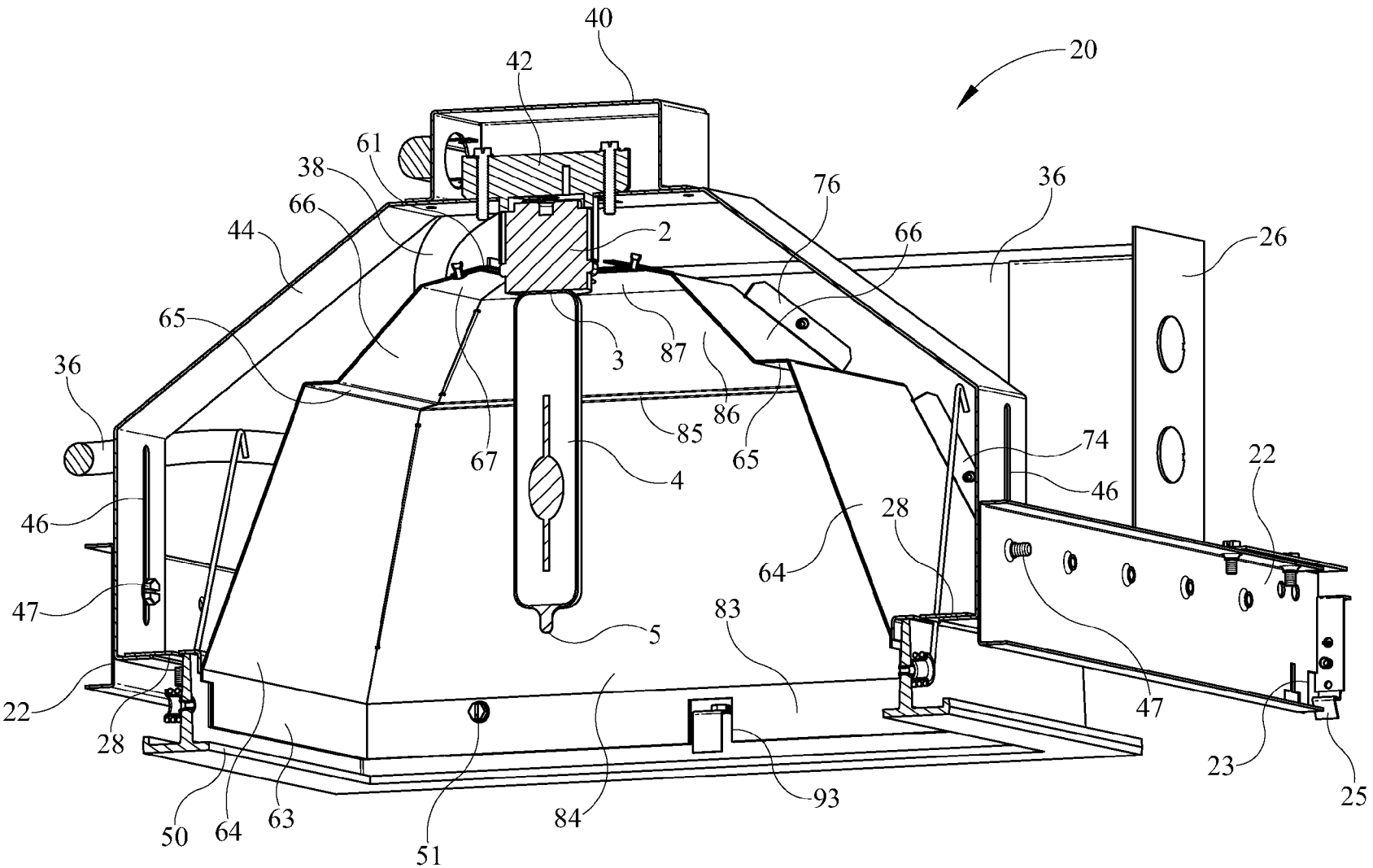
FIG. 2 is a perspective sectional view of the HID recessed luminaire of FIG. 1 taken along the section line 2-2 of FIG. 1.
Figure 3:
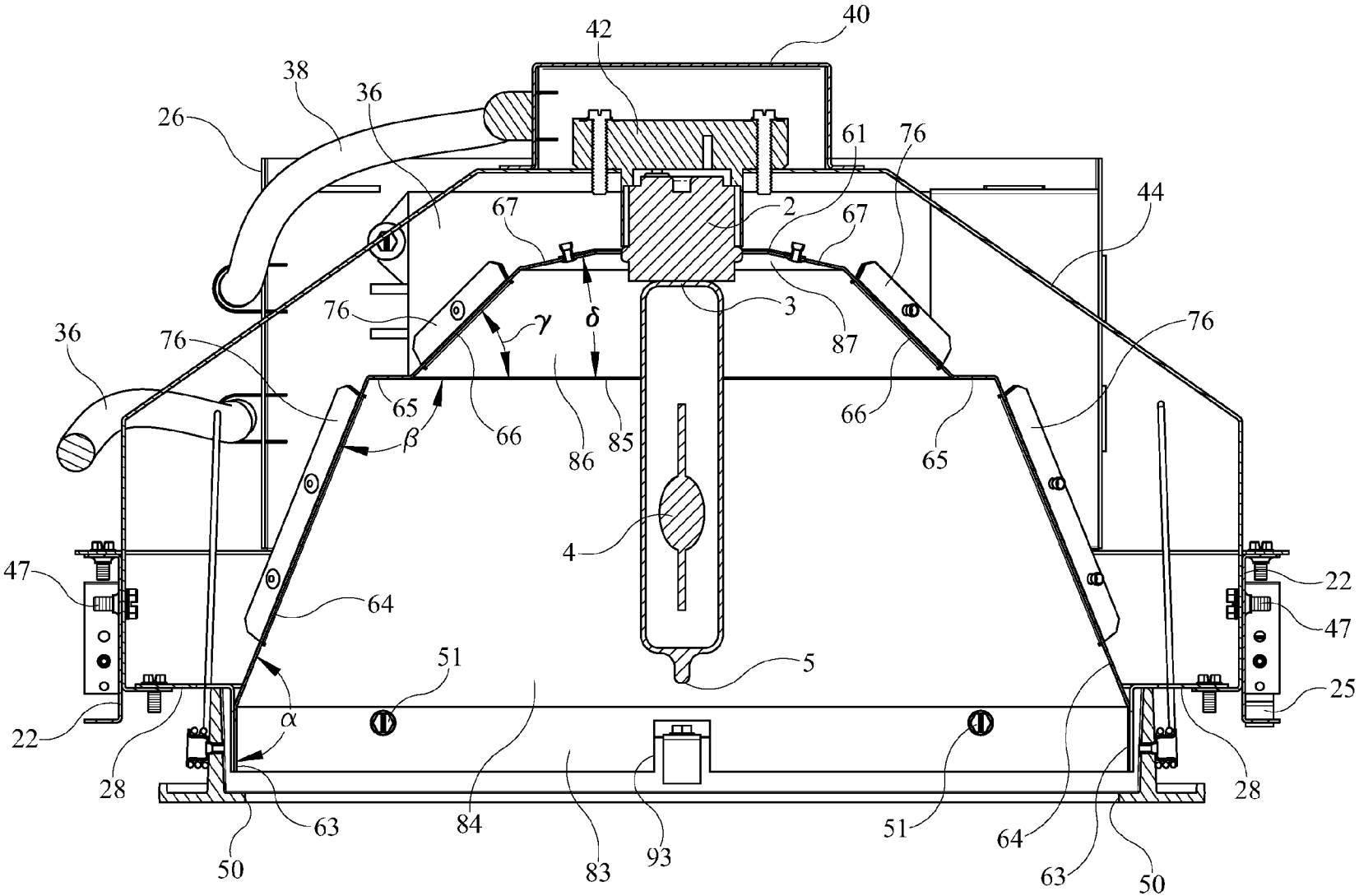
FIG. 3 is a side sectional view of the HID recessed luminaire of FIG. 1 taken along the section line 2-2 of FIG. 1.

Referring now to FIG. 1 through FIG. 6, wherein like numerals refer to like parts, and initially particularly to FIG. 1 through FIG. 3, an embodiment of an HID recessed luminaire 20 having a reflector for a recessed luminaire 60 is described. Recessed luminaire 20 is configured for installation in approximately a two foot by two foot ceiling grid and reflector 60 has approximately a one foot by one foot footprint. C-channels or support structure 22 are provided on opposed sides of reflector 60 and may be attached to a two foot by two foot ceiling grid. Notches 23 and 24 are provided on each end of each c-channel 22 and may accept a ceiling grid support member from a ceiling grid. Springs 25 are provided adjacent three of the four notches 23 and 24 and help to secure the ceiling grid support members within the notches 23 and 24 of c-channels 22. A socket bracket 44 is attached between the two c-channels 22. The socket bracket 44 has four slots 46 with corresponding screws 47 passing therethrough and received in c-channels 22. The screws 47 may be selectively loosened and tightened to allow for vertical adjustment of the socket bracket 44 and all items attached thereto along the length of slots 46.

Socket bracket 44 supports a socket 42 enclosed within a socket cover 40. The socket may support a lamp 4 having a base or lamp cap 2 for removable attachment to the socket 42 and a light emitting portion having a first end 3 adjacent the base 2 and socket 42 and a second end 5 distal the first end 3. In some embodiments the socket 42 may be a socket manufactured by Bender and Wirth and designed to removably engage a Philips MasterColor CDM Elite MW lamp and the lamp may be a 210 Watt or 315 Watt Philips MasterColor CDM Elite MW. The 315 Watt Philips MasterColor CDM Elite MW lamp may produce approximately 37,800 initial lumens and approximately 34,000 mean Lumens. The Philips MasterColor CDM Elite MW may have a length of approximately seven and one quarter inches and a diameter of approximately one and one eighth inches.

Socket bracket 44 may also support a pan 28. The depicted pan is coupled to the socket bracket 44, surrounds reflector 60, and supports junction box 30, reflector 60, and lens frame 50. Junction box 30 has a junction box door 32 for selective access to the interior of junction box 30. A junction box to ballast box conduit 34 runs from the junction box 30 to a transformer or ballast 36 to electrically connect power being ran to the junction box 30 to the transformer 36. The transformer 36 is supported by a transformer bracket 26 that is connected between c-channels 22. A transformer to socket conduit 38 runs form the transformer 36 to the socket 42 and may provide appropriate power output from the transformer 36 to the socket 42. In some embodiments the transformer 36 is an Advance electronic ballast Catalog Number IZTMH-210-315-R accepting 208-277 Volt input and includes a dip switch that can be adjusted to switch between providing appropriate electrical output to power either a 210 Watt or 315 Watt Philips MasterColor CDM Elite MW lamp. When the Philips MasterColor CDM Elite MW lamp and the Advance electronic ballast Catalog Number IZTMH-210-315-R are used they may have a ballast factor of approximately one.

A lens frame 50 is coupled to pan 28 and defines a downlight opening through which light emitted by lamp 4 may exit downwardly to illuminate a desired area. Lens frame 50 may optionally support a lens that may provide a protective covering and/or may alter characteristics of light passing therethrough. In some embodiments of HID recessed luminaire 20, lens frame 50 may support a Solite Glass Lens. In some embodiments of HID recessed luminaire 20, lens frame 50 may be omitted and the base of reflector 60 may define a downlight opening.

Figure 4:
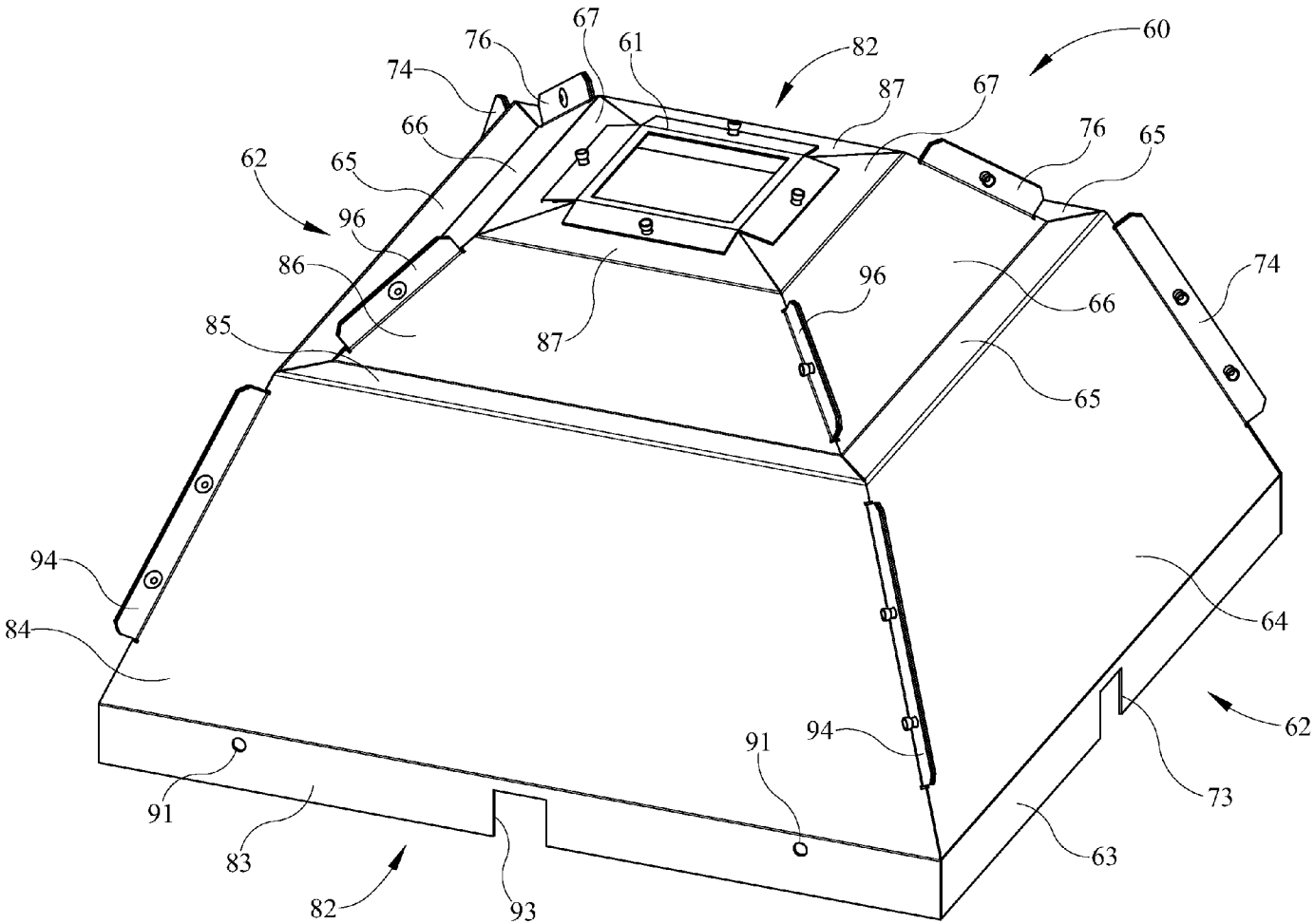
FIG. 4 is a top perspective view of the reflector of the HID recessed luminaire of FIG. 1.
Figure 5:
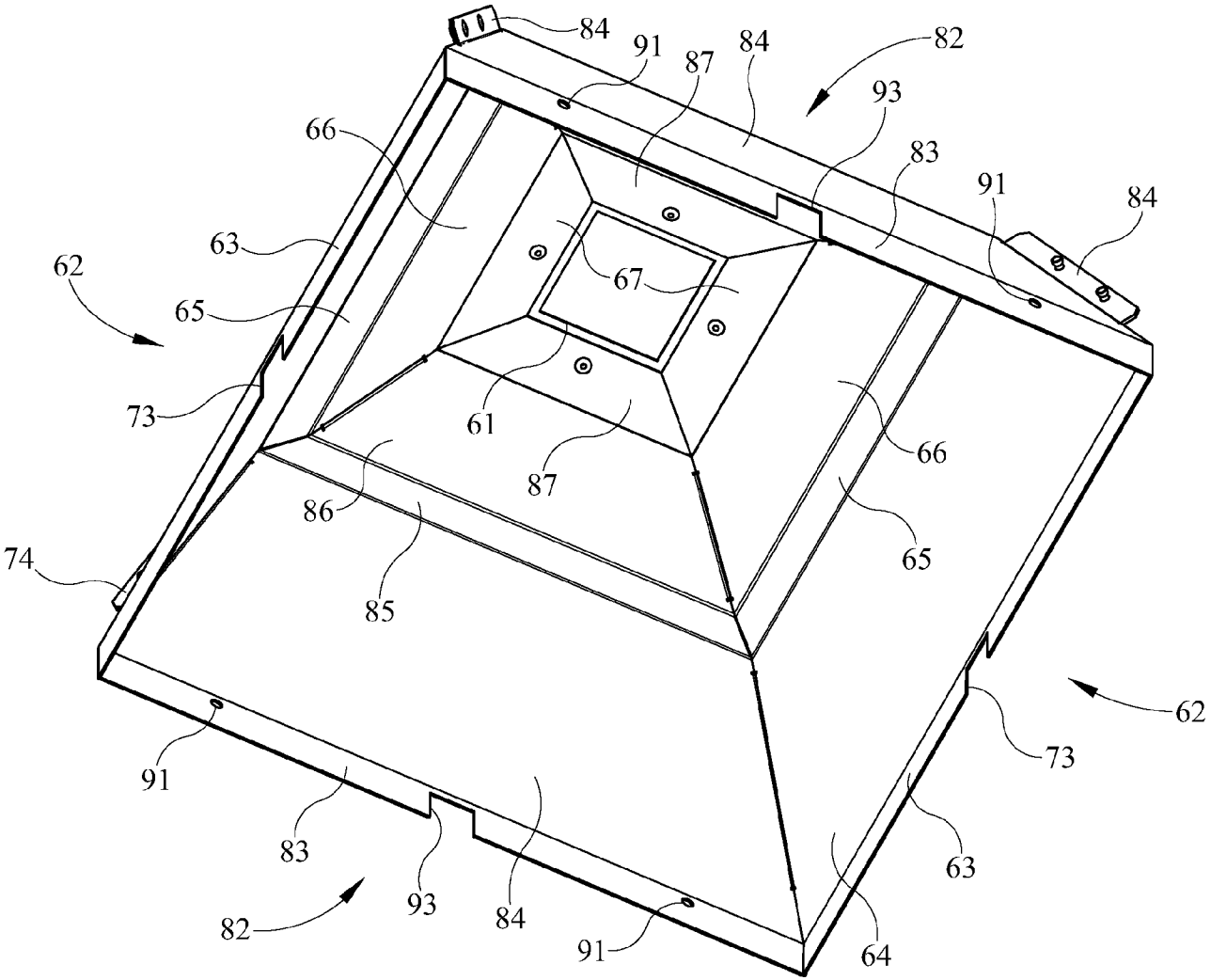
FIG. 5 is a bottom perspective view of the reflector of the HID recessed luminaire of FIG. 1.
Figure 6:
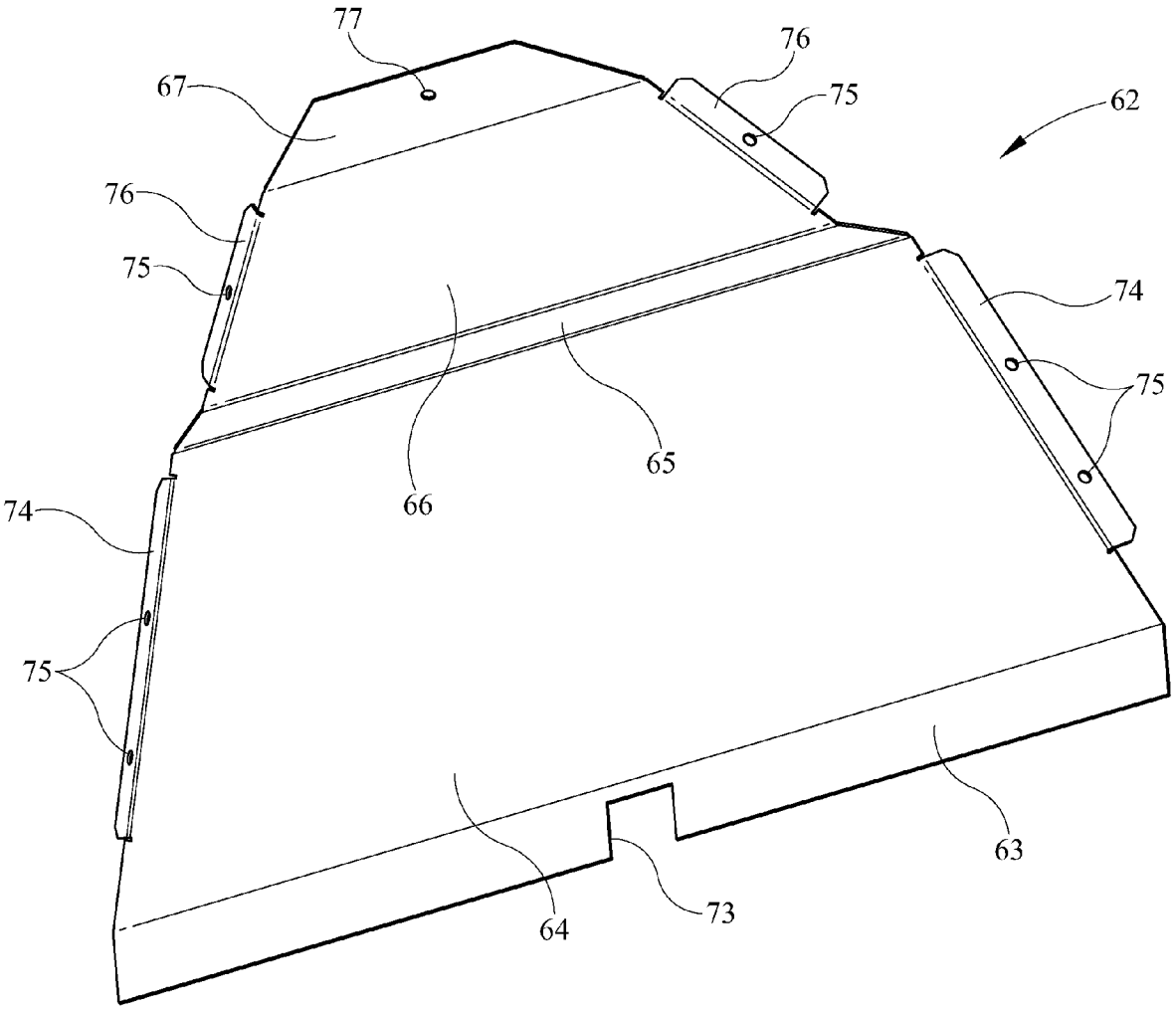
FIG. 6 is a perspective view of one of the reflector pieces of the reflector of the HID recessed luminaire of FIG. 1.

Referring now to FIG. 2 through FIG. 6, reflector 60 is described in more detail. Reflector 60 is attached to pan 28 by screws 51 (see FIG. 2 and FIG. 3) that extend through apertures 91 in skirt portions 83 (see FIG. 4 and FIG. 5) and are received in corresponding apertures of the pan 28. Reflector 60 surrounds lamp 4 and direct light emitted by lamp 4 downwardly to illuminate a desired area. With particular reference to FIGS. 4 through 6, reflector 60 is constructed from four separate reflector pieces 62 and 82 that are coupled to one another. Each of the four depicted reflector pieces 62 and 82 are of a common size and a common shape, and each the reflector pieces 62 and 82 are each individually integrally formed from a single piece of material. The only difference between the two reflector pieces 82 and the two reflector pieces 62 in the depicted embodiment are the apertures 91 provided through skirt portion 83 of reflector pieces 82 for securing reflector 60 to the remainder of the recessed luminaire 20. The numbering distinction between reflector pieces 62 and reflector pieces 82 is present to reflect this difference and for ease in description and understanding of reflector 60.

Each reflector piece 62 includes a wall of a first frustum of a square pyramid 64 and each reflector piece 82 includes a wall of a first frustum of a square pyramid 84. When the four reflector pieces 62 and 82 are assembled together the four walls of a first frustum of a square pyramid 64 and 84 collectively form a first frustum of a square pyramid. The interior facing portions of the first frustum of a square pyramid formed by the four walls of a first frustum of a square pyramid 64 and 84 collectively form a primary reflector.

A skirt portion 63 is integrally connected to the base of each wall of a first frustum of a square pyramid 64 and a skirt portion 83 is integrally connected to the base of each wall of a first frustum of a square pyramid 84. Skirt portions 63 have notches 73 centrally located therein and skirt portions 83 likewise have notches 93 centrally located therein. As seen in FIGS. 2 and 3, notches 73 and 93 allow for clips coupled to lens frame 50 to extend therethrough. The clips extending through notches 73 and 93 may be used to help secure a lens to lens frame 50.

Each reflector piece 62 also includes a wall of a second frustum of a square pyramid 66 and each reflector piece 82 includes a wall of a second frustum of a square pyramid 86. When the four reflector pieces 62 and 82 are assembled together the four walls of a second frustum of a square pyramid 66 and 86 collectively form a second frustum of a square pyramid. The base of the second frustum of a square pyramid is adjacent the top of the first frustum of a square pyramid. The interior facing portions of the second frustum of a square pyramid formed by the four walls of a second frustum of a square pyramid 66 and 86 collectively form a secondary reflector.

A connecting region or plateau 65 extends between the top of each wall of a first frustum of a square pyramid 64 and the base of each wall of a second frustum of a square pyramid 66 and integrally connects the two. A connecting region or plateau 85 extends between the top of each wall of a first frustum of a square pyramid 84 and the base of each wall of a second frustum of a square pyramid 86 and integrally connects the two.

Each reflector piece 62 also includes a wall of a third frustum of a square pyramid 67 and each reflector piece 82 also includes a wall of a third frustum of a square pyramid 87. When the four reflector pieces 62 and 82 are assembled together the four walls of a third frustum of a square pyramid 67 and 87 collectively form a third frustum of a square pyramid. The base of the third frustum of a square pyramid is adjacent the top of the second frustum of a square pyramid. The interior facing portions of the third frustum of a square pyramid formed by the four walls of a third frustum of a square pyramid 67 and 87 collectively form a tertiary reflector.

A reflector top piece 61 may be secured to the third frustum of a square pyramid formed by the four walls of a third frustum of a square pyramid 67 and 87. Rivets or other fasteners may extend through the top piece 61 and an aperture in each of the walls of the third frustum of a square pyramid 67 and 87 (see e.g. aperture 77 in FIG. 6) to secure the reflector top piece 61. The reflector top piece 61 and/or the opening through the top of the third frustum of a square pyramid may define a lamp socket aperture through which a lamp may access and be removably coupled to a lamp socket. Reflector top piece 61 may also help to structurally connect each of the four reflector pieces 62 and 82 to one another. First frustum flanges 74 and 94 and/or second frustum flanges 76 and 86 may additionally or alternatively be provided to help structurally connect each of the four reflector pieces 62 and 82 to one another. As shown in FIG. 6, each first frustum flange 74 of reflector piece 62 has two apertures 75 therethrough and each second frustum flange 76 has one aperture 75 therethrough. First frustum flange 94 and second frustum flange 96 of reflector piece 82 share the same construction.

When the four reflector pieces 62 and 82 are coupled to one another each first frustum flange 74 of each reflector piece 62 will be abutted against a first frustum flange 94 of a reflector piece 82 and each second frustum flange 76 of each reflector piece 62 will be abutted against a second frustum flange 96 of a reflector piece 82. Rivets or other fasteners may then be inserted through the apertures in each of flanges 74 and 94 and 76 and 96 to secure the reflector pieces 62 and 82 to one another. The flanges 74, 76, 94, and 96 extend outwardly from the interior of the reflector 60 and do not cause any unsightly screws, rivets, or other fasteners to be present on the interior facing portions of the primary reflector or secondary reflector.

Each of the four reflector pieces 62 and 82 are of a common size and a common shape, and the reflector pieces 62 and 82 are each individually integrally formed from a single piece of material. No unsightly screws are needed to connect each wall of a first frustum of a square pyramid 64/84 to each wall of a second frustum of a square pyramid 66/86 and gaps or misalignment between the two walls is not a concern. The only difference between the two reflector pieces 82 and the two reflector pieces 62 are the apertures 91 provided through skirt portion 83 of reflector pieces 82. Each of the four reflector pieces 62 and 82 can made using a manufacturing process that creates just one common piece and four of the common pieces may be used to form the reflector 60. Separate holes may be drilled in one or more reflector pieces if desired for apertures 91 or otherwise, eliminating the need for separate reflector pieces to be manufactured. In some embodiments the reflector pieces 62 and 81 may be created using a blank and form manufacturing process.

Referring now to FIG. 3, specific angles and heights present in the depicted embodiment of the reflector 60 are described in more detail. An angle $\alpha$ between skirt portion 63 and the wall of a first frustum of a square pyramid 64 is approximately one-hundred and fifty-eight degrees. An angle $\beta$ between the wall of a first frustum of a square pyramid 64 and the plateau 65 is approximately one-hundred and twelve degrees. The angle $\gamma$ between the plateau 65 and the wall of the second frustum of a square pyramid 66 is approximately forty-five degrees. The angle $\delta$ between the plateau 65 and the wall of the third frustum of a square pyramid 67 is approximately twelve degrees. In the depicted embodiment the angles in the unmarked reflector piece 62 and the two reflector pieces 82 are approximately the same as those just described. In the depicted embodiment the skirt portions 63 and 83 are approximately 0.87 inches tall in a vertical direction, the first frustum of a square pyramid is approximately 4.4 inches tall in a vertical direction, the second frustum of a square pyramid is approximately 1.45 inches tall in a vertical direction, and the tertiary frustum of a square pyramid is approximately 0.21 inches tall in a vertical direction. The footprint of the first frustum of a square pyramid of the depicted reflector 60 is approximately one foot by one foot. Thus, the depicted reflector 60 has an approximately one foot by one foot footprint and a total reflector depth of approximately seven inches.

In some embodiments the reflector 60 may be manufactured from unpainted MIRO 4 aluminum. In some embodiments when the reflector 60 is used with a 315 Watt Philips MasterColor CDM Elite MW lamp better optical control and higher efficiency may be achieved compared to traditional two foot by two foot reflectors using a 320 Watt bulb. Higher light levels can be achieved with the same number of luminaires while reducing energy consumption compared to traditional two foot by two foot reflectors using a 320 Watt bulb.

When using the Philips MasterColor CDM Elite MW lamp producing 37,800 lumens, the Advance electronic ballast Catalog Number IZTMH-210-315-R, and a Solite glass lens in the lens frame 50, the recessed luminaire 20 may produce a total fixture output of approximately 33,059 lumens, for a fixture efficiency of approximately 87.5% and approximately 98.7 lumens per Watt.

The foregoing description has been presented for purposes of illustration. It is not intended to be exhaustive or to limit the invention to the precise forms disclosed, and obviously many modifications and variations are possible in light of the above teaching. It is understood that while certain forms of the invention have been illustrated and described, it is not limited thereto except insofar as such limitations are included in the following claims and allowable functional equivalents thereof.

We claim:

1. An HID recessed luminaire, comprising:

a lens frame defining a downlight opening;

a HID socket disposed vertically above said downlight opening;

a longitudinally extending HID lamp removably coupled to said HID socket and extending downwardly toward said downlight opening in a substantially vertical orientation;

said HID lamp having a light emitting portion having a first end adjacent said HID socket and a second end distal said first end;

a reflector surrounding said HID lamp, said reflector extending from adjacent said downlight opening to adjacent said HID socket, said reflector having a primary reflector portion and a secondary reflector portion;

said primary reflector portion defining a first frustum of a square pyramid extending from a first frustum base adjacent said downlight opening to a first frustum top disposed vertically above said first frustum base more proximal said HID socket than said first frustum base;

said secondary reflector portion defining a second frustum of a square pyramid having a second frustum base and a second frustum top, said second frustum base adjacent said first frustum top and of a smaller footprint than said first frustum top, said second frustum top disposed vertically above said second frustum base more proximal said HID socket than said second frustum base;

wherein said primary reflector surrounds over half of said HID lamp; and wherein at least a portion of said primary reflector and at least a portion of said secondary reflector are integrally connected to one another and integrally formed from a common piece of material, wherein a horizontally planar plateau portion substantially parallel to said downlight opening integrally connects said at least a portion of said first reflector portion and said at least a portion of said second reflector portion.

2. The HID recessed luminaire of claim 1, wherein said reflector further includes a skirt sidewall portion extending vertically downward from said first frustum base, said skirt sidewall substantially perpendicular to said downlight opening.

3. The HID recessed luminaire of claim 2, wherein said skirt sidewall has a plurality of securing apertures therethrough.

4. The HID recessed luminaire of claim 1, wherein the distance between said first frustum base and said first frustum top is at least three times the distance between said second frustum base and said second frustum top.

5. The HID recessed luminaire of claim 4, wherein the footprint of said first frustum base is less than or equal to one foot by one foot.

6. The HID recessed luminaire of claim 4, wherein said reflector is formed from four separate reflector pieces coupled to one another, each of said reflector pieces being integrally formed from a single piece of material and defining one wall of said first frustum of a pyramid and one wall of said second frustum of a pyramid.

7. An HID recessed luminaire having a reflector with an approximately one foot by one foot footprint and configured for installation in an approximately two foot by two foot ceiling grid, comprising:

a downlight opening;

a HID socket disposed vertically above said downlight opening;

said reflector extending from adjacent said downlight opening to adjacent said HID socket, said reflector having a primary reflector portion and a secondary reflector portion;

said primary reflector portion defining a first frustum of a pyramid extending from a first frustum base adjacent said downlight opening to a first frustum top disposed vertically above said first frustum base more proximal said HID socket than said first frustum base;

said secondary reflector portion defining a second frustum of a pyramid having a second frustum base and a second frustum top, said second frustum base adjacent said first frustum top and of a smaller footprint than said first frustum top, said second frustum top disposed vertically above said second frustum base more proximal said HID socket than said second frustum base;

wherein said reflector includes separate reflector pieces coupled to one another, each of said reflector pieces being commonly shaped, commonly sized, and integrally formed from a single piece of material;

wherein each of said reflector pieces includes one wall of said first frustum of a pyramid having a first frustum wall base and a first frustum wall top and one wall of said second frustum of a pyramid having a second frustum wall base and a second frustum wall top;

wherein said first frustum wall top and said second frustum wall base of each of said reflector pieces are integrally connected to one another, wherein a horizontally planar plateau portion substantially parallel to said downlight opening integrally connects each said first frustum wall top and each said second frustum wall base of each of said reflector pieces.

8. The HID recessed luminaire of claim 7, wherein the interior facing portions of said primary reflector portion and said secondary reflector portion are relatively smooth and free of fasteners.

9. An HID recessed luminaire having a reflector configured for installation in an approximately two foot by two foot ceiling grid, comprising:

a downlight opening;

a HID socket disposed vertically above said downlight opening;

a longitudinally extending HID lamp removably coupled to said HID socket and extending downwardly toward said downlight opening in a substantially vertical orientation;

wherein said HID lamp produces approximately 37,800 initial lumens;

said reflector surrounding said HID lamp and having an approximately one foot by one foot footprint and a reflector depth of less than seven inches;

said reflector having four separate reflector pieces coupled to one another, each of said reflector pieces being of a common size, a common shape, and integrally formed from a single piece of material;

wherein each of said reflector pieces includes one wall of a first frustum of a square pyramid and one wall of a second frustum of a square pyramid;

each said one wall of a first frustum of a square pyramid having a first frustum base, a first frustum top, and first frustum sides extending between said first frustum base and said first frustum top;

each said one wall of a second frustum of a square pyramid having a second frustum base, a second frustum top, and second frustum sides extending between said second frustum base and said second frustum top;

wherein each said one wall of a first frustum of a square pyramid is larger than each said one wall of a second frustum of a square pyramid;

wherein each said first frustum top is adjacent and integrally connected to each said second frustum base;

wherein said four separate reflector pieces are coupled to one another such that a first frustum of a square pyramid and a second frustum of a square pyramid are formed; and wherein said HID recessed luminaire has a fixture efficiency of approximately 87%, wherein a horizontally planar plateau portion substantially parallel to said downlight opening integrally connects each said first frustum top and each said second frustum base.

10. The HID recessed luminaire of claim 9, wherein each said reflector piece further includes a skirt sidewall portion extending from said first frustum base in a direction away from said one wall of a second frustum of a square pyramid.

11. The HID recessed luminaire of claim 9, wherein each of said reflector pieces further includes one wall of a third frustum of a square pyramid having a third frustum base and a third frustum top; wherein each said one wall of a second frustum of a square pyramid is larger than each said one wall of a third frustum of a square pyramid; and wherein each said second frustum top is adjacent and integrally connected to each said third frustum base.

12. The HID recessed luminaire of claim 10, wherein the distance between each said first frustum base and each said first frustum top is at least three times the distance between each said second frustum base and each said second frustum top.

13. The HID recessed luminaire of claim 9, wherein each of said reflector pieces further includes integrally formed first frustum flanges, at least one of said first frustum flanges extending from each of said first frustum sides of each of said reflector pieces in a direction outward from said first frustum of a square pyramid and coupled to a corresponding of said first frustum flanges on an adjacent of said reflector pieces.

14. The HID recessed luminaire of claim 13, wherein each of said reflector pieces further includes integrally formed second frustum flanges, at least one of said second frustum flanges extending from each of said second frustum sides of each of said reflector pieces in a direction outward from said first frustum of a square pyramid and coupled to a corresponding of said second frustum flanges on an adjacent of said reflector pieces.

15. The HID recessed luminaire of claim 13, wherein said at least one of said first frustum flanges extending from each of said first frustum sides of each of said reflector pieces has at least one aperture therethrough and is coupled to a corresponding of said first frustum flanges on an adjacent of said reflector pieces having at least one aperture therthrough by a fastener extending through each said at least one aperture.

* * * * *